US010258443B2

(12) United States Patent
Goddard et al.

(10) Patent No.: US 10,258,443 B2
(45) Date of Patent: Apr. 16, 2019

(54) BRUSH HEAD ASSEMBLY AND METHODS OF MANUFACTURE

(71) Applicant: KONINKLIJKE PHILIPS N.V., Eindhoven (NL)

(72) Inventors: Gregory Russ Goddard, Kenmore, WA (US); Evan Dak Wah Dengler, Seattle, WA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 208 days.

(21) Appl. No.: 15/127,897

(22) PCT Filed: Mar. 24, 2015

(86) PCT No.: PCT/IB2015/052131
§ 371 (c)(1),
(2) Date: Sep. 21, 2016

(87) PCT Pub. No.: WO2015/145340
PCT Pub. Date: Oct. 1, 2015

(65) Prior Publication Data

US 2017/0095321 A1 Apr. 6, 2017

Related U.S. Application Data

(60) Provisional application No. 62/025,039, filed on Jul. 16, 2014, provisional application No. 62/008,762,
(Continued)

(51) Int. Cl.
*A61C 17/22* (2006.01)
*A46B 9/04* (2006.01)
(Continued)

(52) U.S. Cl.
CPC ..... *A61C 17/222* (2013.01); *A46B 3/00* (2013.01); *A46B 3/20* (2013.01); *A46B 5/0029* (2013.01);
(Continued)

(58) Field of Classification Search
CPC ..... A61C 17/222; A46B 3/20; A46B 5/0029; A46B 9/00; A46B 9/04; A46B 2200/1066; A46D 3/00
See application file for complete search history.

(56) References Cited

U.S. PATENT DOCUMENTS 5,802,656 A 9/1998 Dawson et al.
5,970,564 A * 10/1999 Inns ..... A46B 7/06 15/201
(Continued)

FOREIGN PATENT DOCUMENTS

WO 9315628 A1 8/1993
WO 9812948 A1 4/1998
(Continued)

*Primary Examiner* — Dung Van Nguyen

(57) ABSTRACT

A brush head assembly (100) including: a hard platen (24); a plurality of bristle tufts (21), each of which includes a plurality of bristle strands having a proximal end (23) and a free end (25); and an elastomeric matrix (30) bonded to the hard platen, where each of the bristle tufts is bonded directly to the elastomeric matrix without a retention element. A brush head assembly (100) includes: a hard platen (24) with a plurality of bristle tuft holes (28); a plurality of bristle tufts (21), each of which includes a plurality of bristle strands having a proximal end (23) and a free end (25), where each of the plurality of bristle tufts are inserted into a respective one of the bristle tuft holes; and an elastomeric matrix (30) that at least partially encompasses the hard platen and the proximal end of the bristle tufts.

7 Claims, 10 Drawing Sheets

Related U.S. Application Data filed on Jun. 6, 2014, provisional application No. 61/974,760, filed on Apr. 3, 2014, provisional application No. 61/970,076, filed on Mar. 25, 2014, provisional application No. 61/970,011, filed on Mar. 25, 2014, provisional application No. 61/970,157, filed on Mar. 25, 2014, provisional application No. 61/970,169, filed on Mar. 25, 2014.

(51) Int. Cl.

| | |
|---|---|
| ***A46B 3/20*** | (2006.01) |
| ***A46B 5/00*** | (2006.01) |
| ***A46B 9/00*** | (2006.01) |
| ***A46B 3/00*** | (2006.01) |

(52) U.S. Cl.

CPC ..... *A46B 9/00* (2013.01); *A46B 9/04* (2013.01); *A46B 2200/1066* (2013.01)

(56) References Cited

U.S. PATENT DOCUMENTS

| | | | | |
|---|---|---|---|---|
| 6,036,277 | A * | 3/2000 | Weihrauch | A46B 3/20 15/186 |
| 7,520,016 | B2 | 4/2009 | Kressner | |
| 8,069,524 | B2 | 12/2011 | Kraemer | |
| 2001/0050507 | A1* | 12/2001 | Boucherie | A46D 3/04 300/21 |
| 2003/0154567 | A1 | 8/2003 | Drossler et al. | |
| 2011/0107531 | A1 | 5/2011 | Ye | |
| 2012/0317737 | A1* | 12/2012 | Birk | A46B 3/06 15/106 |
| 2017/0135462 | A1* | 5/2017 | Willi | A46B 7/02 |

FOREIGN PATENT DOCUMENTS

| | | | |
|---|---|---|---|
| WO | 2004080238 | A1 | 9/2004 |
| WO | 2005013762 | A1 | 2/2005 |

* cited by examiner

BRUSH HEAD ASSEMBLY AND METHODS OF MANUFACTURE

CROSS-REFERENCE TO PRIOR APPLICATIONS

This application is the U.S. National Phase application under 35 U.S.C. § 371 of International Application No. PCT/IB2015/052131, filed on Mar. 24, 2015, which claims the benefit of U.S. Provisional Patent Application Nos. 62/025,039, filed on Jul. 16, 2014, 62/008,762, filed on Jun. 6, 2014, 61/974,760, filed on Apr. 3, 2014, 61/970,076, filed on Mar. 25, 2014, 61/970,011 filed on Mar. 25, 2014, 61/970,157, filed on Mar. 25, 2014, 61/970,169, filed on Mar. 25, 2014. These applications are hereby incorporated by reference herein.

FIELD OF THE INVENTION

The present disclosure is directed generally to a brush head assembly with bristle tufts retained within an elastomeric matrix, as well as to methods for manufacturing the brush head assembly.

BACKGROUND

Periodontal diseases are thought to be infectious diseases caused by bacteria present in dental plaques. Removal of dental plaques is highly important for the health of oral cavities. Tooth brushing is a highly effective method to remove dental plaque from the teeth. Power toothbrushes can enhance the removal of dental plaque. Such power toothbrushes have a set of bristles attached to a brush head which is moved by a driver that causes the bristles to scrub dental surfaces.

To improve oral care, it is desirable to provide a toothbrush with bristles packed as densely as possible. Densely packed bristles improve oral care, improve the removal of dental plaque from the teeth, and improve the cleaning of other dental surfaces. Bristle density may be increased by, for example, increasing the number of bristles in a tuft, or by increasing the number of tufts on a brush head, both of which can be accomplished without increasing the size of the brush head.

However, for structural reasons, including maintaining the structural strength and integrity of the brush head, a minimum distance must be maintained between tuft holes. As a result, there is a limit as to how big the bristle tufts can be, and how many bristle tufts can be placed on a brush head of a certain size. These structural requirements therefore limit the overall density of the bristles on the brush head.

Accordingly, there is a need in the art for brush head assemblies, and methods of their manufacture, that increase the density of the bristles on the brush head and therefore improve oral care.

SUMMARY OF THE INVENTION

The present disclosure is directed to inventive brush heads with densely packed bristle tufts permanently retained within an elastomeric matrix without a retention element such as a ring, sleeve, or anchor. Various embodiments and implementations herein are directed to brush heads in which bristle tufts are affixed with or to a hard platen and are then embedded within an elastomeric matrix resulting in a completed brush head. Using the various embodiments and implementations herein, cost-effective and efficient production of brush heads with secured bristle tufts is substantially improved. For example, in some embodiments, the manufacturing method includes inserting a tuft of bristles into a hard platen, securing the bristle tuft to the hard platen, and at least partially encompassing the hard platen and the bristle tuft in an elastomeric matrix.

The brush heads disclosed and described herein can be used with any manual or power toothbrush device. One example of a power toothbrush device that the brush head can be used with Sonicare® devices available from Koninklijke Philips Electronics N.V. This oral care device is based upon an actuator with a reciprocating brush head including bristles to provide an effective cleaning of a user's teeth.

Generally in one aspect, a brush head assembly includes: (i) a hard platen; (ii) a plurality of bristle tufts, each of which comprises a plurality of bristle strands having a proximal end and a free end; and (iii) an elastomeric matrix bonded to the hard platen and a portion of the proximal end of each bristle tuft, wherein each of the plurality of bristle tufts is bonded at its proximal end directly to the elastomeric matrix without a retention element.

According to an embodiment, the bristle strands are made of nylon.

According to an embodiment, the bristle strands are coated with a polymer that promotes bonding of the bristle tufts to the elastomeric matrix. According to an embodiment, the polymer is selected from the group consisting of polyurethane, polybutylene terephthalate, polyolefin, and combinations thereof.

Generally, in one aspect, a brush head assembly includes: (i) a hard platen comprising a plurality of bristle tuft holes; (ii) a plurality of bristle tufts, each of which comprises a plurality of bristle strands having a proximal end and a free end, wherein each of the plurality of bristle tufts are inserted into a respective one of the bristle tuft holes; and (iii) an elastomeric matrix that at least partially encompasses the hard platen and the proximal end of the bristle tufts.

According to an embodiment, the bristle tufts are fused to the bristle tuft holes.

According to an embodiment, the hard platen is a portion of the neck of the brush head.

According to an embodiment, the brush head includes a second hard platen, and the elastomeric matrix is formed between the hard platen and the second hard platen.

According to an embodiment, the elastomeric matrix completely encompasses the hard platen and the proximal end of the bristle tufts.

According to an embodiment, the bristles are made of nylon, and the elastomeric matrix is a flexible thermoplastic elastomer.

Generally, in one aspect, a method for manufacturing a brush head includes the steps of: (i) providing a hard platen comprising a plurality of bristle tuft holes; (ii) inserting a respective bristle tuft proximal end into each of the bristle tuft holes; and (iii) injecting a thermoplastic elastomer to create an elastomeric matrix that at least partially encompasses the hard platen and the proximal end of the bristle tufts.

According to an embodiment, the method further includes the step of applying heat to each bristle tuft proximal end at a temperature sufficient to at least partially fuse the bristle tuft proximal end to the bristle tuft hole.

Generally, in one aspect, a method for manufacturing a brush head includes the steps of: (i) positioning a proximal end of each of a plurality of bristle tufts into a plate; (ii) injecting a thermoplastic elastomer to create an elastomeric matrix that at least partially encompasses each of the plurality of bristle tufts; (iii) removing the plate to expose the proximal end of each of the plurality of bristle tufts extending from the elastomeric matrix; and (iv) applying heat to each bristle tuft proximal end at a temperature sufficient to at least partially melt the bristle tuft proximal end and create a proximal head portion.

According to an embodiment, the method further includes the step of injecting additional thermoplastic elastomer to encompass the proximal head portion of each of the plurality of bristle tufts.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of a brush head assembly with bristle tufts retained within an elastomeric matrix, and methods of their manufacture. More generally, Applicants have recognized and appreciated that it would be beneficial to provide a brush head formed from an elastomeric matrix to provide movement while improving bristle retention, without simultaneously requiring a retention element such as a ring, sleeve, anchor, or webbing. For example, bristle tuft packing placement can restrict or enhance movement of a flexible elastomeric matrix, which can be beneficial to a brush head's function, especially in powered toothbrush devices. A particular goal of utilization of certain embodiments of the present disclosure is the ability to efficiently manufacture brush heads with improved retention of the bristle tuft.

In view of the foregoing, various embodiments and implementations are directed to a brush head assembly in which a bristle tuft is affixed to or within an elastomeric matrix without a retention element such as a ring, sleeve, anchor, or webbing. Alternatively, the bristle tuft is affixed to or within a hard platen and is then embedded at least partially within an elastomeric matrix.

Figure 1:
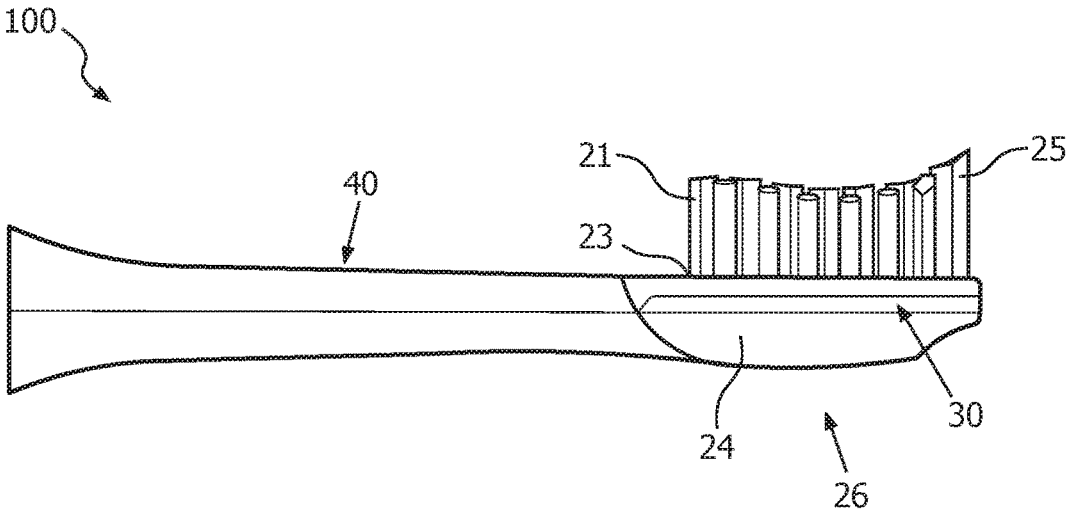
FIG. 1 is a schematic representation of a side view of a brush head assembly in accordance with an embodiment.

Referring to FIG. 1, in one embodiment, a schematic representation of a brush head assembly 100 is provided. The brush head includes a neck 40, which can be coupled to any manual brush shaft, or, more preferably, to any actuator and drive shaft (not shown) made or suitable for oral care devices now known or to be developed. The brush head also includes a plurality of bristle tufts 21, each of which comprises a plurality of bristle strands. According to an embodiment, the bristle tufts are composed of nylon, or another suitable material. Each bristle tuft includes a proximal end 23 and a free end 25, where the proximal end of each bristle tuft and the hard platen 24 portion of the neck 40 is retained within a flexible elastomeric matrix 30 to form a head portion 26 of the brush head assembly 100. According to an embodiment, the elastomeric matrix 30 is preferably made from a flexible thermoplastic elastomer (TPE). The neck 40 and platen 24 portion thereof are preferably made from a material with a higher elastic modulus value than the elastomeric matrix 30.

Figure 2:
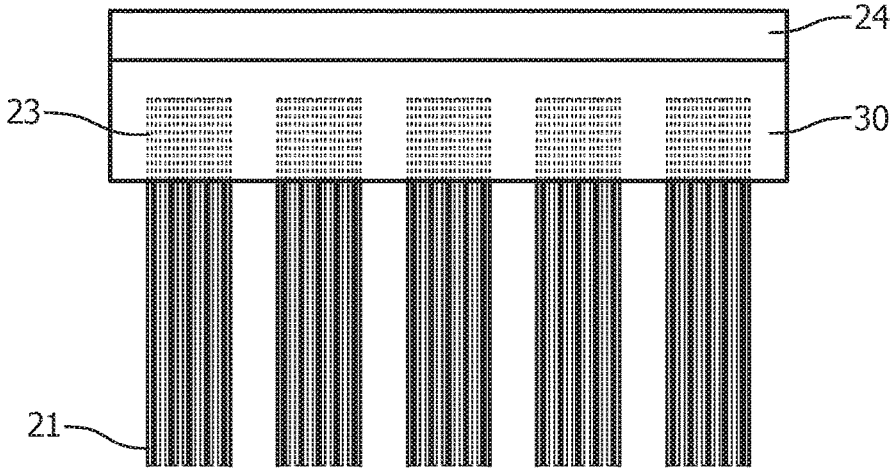
FIG. 2 is a schematic representation of a portion of a brush head assembly in accordance with an embodiment.

During use, forces are exerted on the bristles that can result in the bristles being removed or expelled from the bristle tuft. Accordingly, it is necessary to improve retention of bristles and bristle tufts within the brush head, including within the elastomeric matrix. Referring to FIG. 2, in one embodiment, is a portion of a brush head designed to improve retention of bristles and bristle tufts 21 within the elastomeric matrix 30 of the brush head, without simultaneously requiring a retention element such as a ring, sleeve, anchor, or webbing. In this embodiment, the individual bristles within bristle tufts 21 can be made of nylon, and optionally can be coated with polyurethane, polybutylene terephthalate (PBT), polyolefin, combinations of these, or a similar polymer. The thermoplastic elastomer is then molded over or around the proximal end 23 of the bristle tufts and the platen 24 to form the elastomeric matrix 30 within which the bristle tufts are retained. According to an embodiment, the elastomer is allowed to sufficiently impregnate each of the bristle tufts 21, and increased packing density is realized without compromising the flexibility of the elastomeric matrix 30. This can be accomplished, for example, by increasing the temperature or duration of time that the bristle tufts are exposed to heat and/or thermoplastic elastomer. The elastomeric matrix 30 is also bound to the hard platen 24 portion of the neck 40. The proximal ends 23 of the bristle tufts are heated to at least partially melt and fuse the bristles to the elastomeric matrix. The heat can be supplied by a heat source that comes into direct physical contact with the proximal end 23 of the bristle tufts, or the heat can be supplied by heated air or any of a variety of other heat sources.

Figure 3:
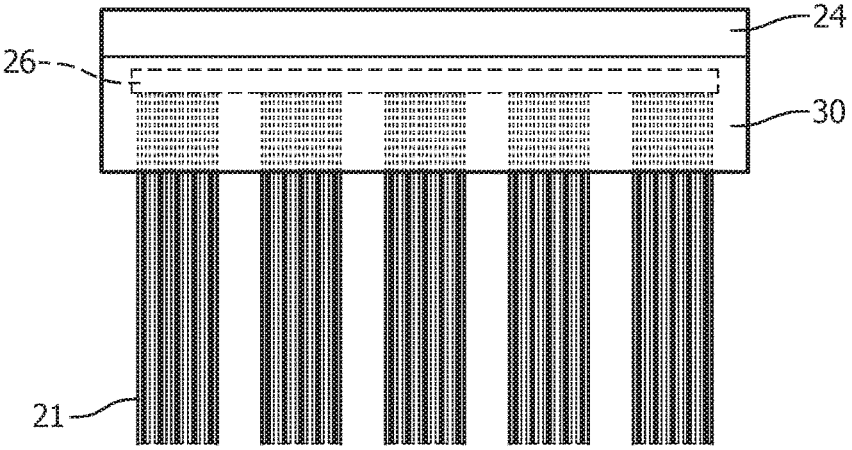
FIG. 3 is a schematic representation of a portion of a brush head assembly in accordance with an embodiment.

Referring to FIG. 3, in one embodiment, is a portion of a brush head. In this embodiment, the individual bristles within bristle tufts 21 can be made of nylon, and are coated with polyurethane, polybutylene terephthalate (PBT), polyolefin, or a similar polymer. The proximal ends 23 of the bristle tufts are heated to at least partially melt and fuse the bristles together, thereby creating a single proximal end head portion 26. The heat can be supplied by a heat source that comes into direct physical contact with the proximal end 23 of the bristle tufts, or the heat can be supplied by heated air or any of a variety of other heat sources. The thermoplastic elastomer is then molded over or around the proximal end head portion 26 of the bristle tufts to form the elastomeric matrix 30 within which the bristle tufts are retained. The elastomeric matrix 30 is also bound to the hard platen 24 portion of the neck 40.

According to another embodiment, the hard platen 24 can be designed to promote fusing of the elastomeric matrix to the platen. For example, if the platen is made from materials such as Spandex®, PolyMeg®, or similar copolymers, this would allow fusing of the elastomer matrix to the platen, thereby increasing retention forces. In addition, this design provides additional flexibility to the bristle tuft within the platen, and therefore additional degrees of freedom of motion within the brush head.

Figure 4A:
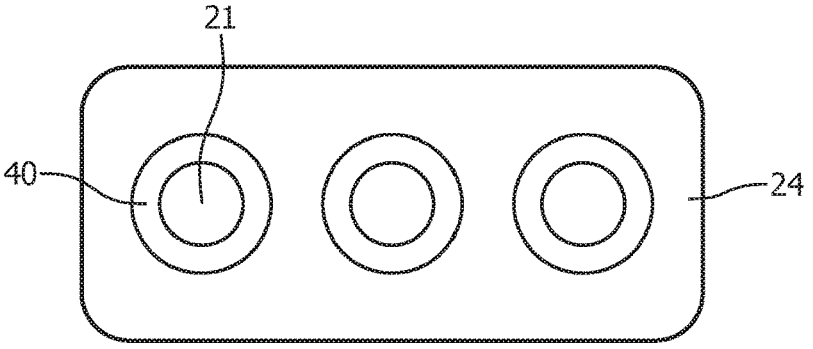
FIG. 4A is a schematic representation of a hard platen with elastomeric retention rings in accordance with an embodiment.
Figure 4B:
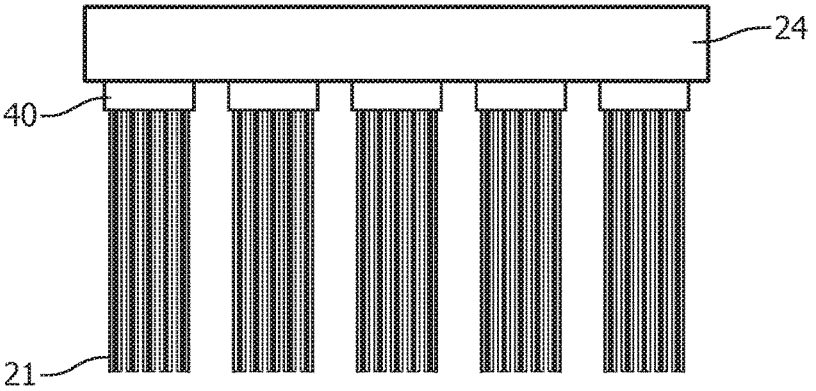
FIG. 4B is a schematic representation of a portion of a brush head assembly in accordance with an embodiment.

Referring to FIG. 4A, in one embodiment, is a top view of a portion of a brush head in which elastomeric retention rings are embedded within hard platen 24. The side view of this embodiment is shown in FIG. 4B. Although the elastomeric retention rings 40 partially extend from the hard platen in this figure, they may be level with the hard platen surface, or partially recessed within the hard platen and therefore below the platen surface. It would be possible to use much softer elastomeric materials, such as polyolefin or vinyl-alkene block or graft copolymers, and thereby achieve much higher amplitude of tuft/bristle motion than through standard hard platen approaches.

Figure 5A:
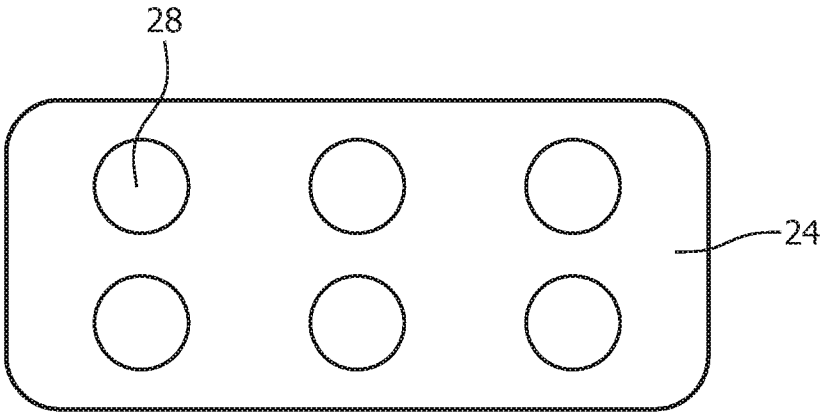
FIG. 5A is a schematic representation of a hard platen with bristle tuft holes in accordance with an embodiment.
Figure 5B:
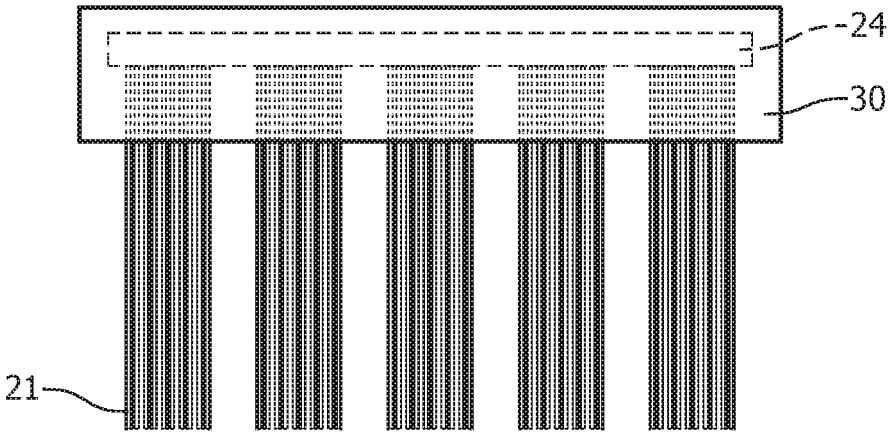
FIG. 5B is a schematic representation of a portion of a brush head assembly in accordance with an embodiment.

Referring to FIGS. 5A and 5B, in one embodiment, is a portion of a brush head assembly 100 using both a hard platen and an elastomeric matrix. Bristle tufts 21 can be melted or dissolved directly into the hard platen 24, or the bristle tufts 21 can be inserted into bristle tuft holes 28 in the hard platen 24. The bristles can be free within the bristle tuft holes, or can be melted or fused into the bristle tuft holes, or can be molded in place. The thermoplastic elastomer is then molded over or around the hard platen 24 containing the proximal end 23 of the bristle tufts to form the elastomeric matrix 30 within which the bristle tufts 21 and the hard platen 24 are retained, as shown in FIG. 5B. The bristle tufts 21 can be melted or dissolved directly into the hard platen 24 by designing the bristle tufts and hard platen with specific structural characteristics and melting temperatures.

Figure 6:
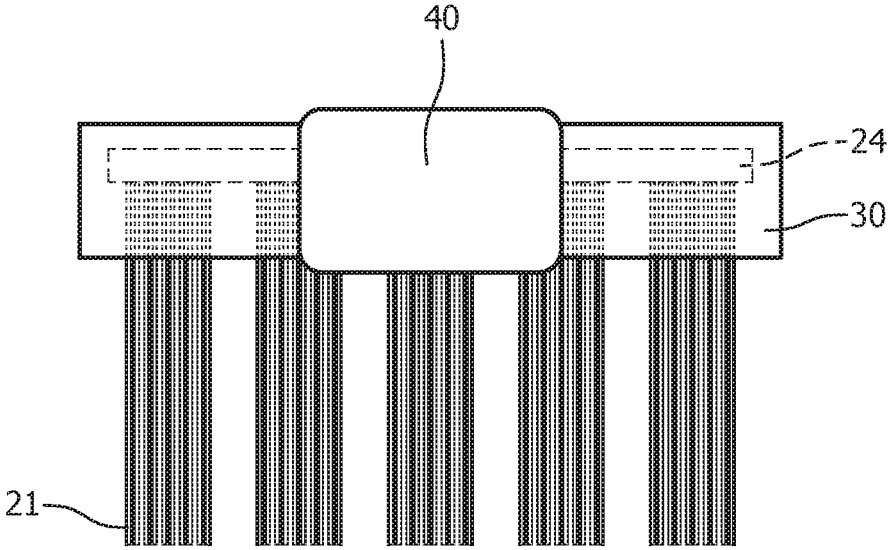
FIG. 6 is a schematic representation of a portion of a brush head assembly in accordance with an embodiment.
Figure 7:
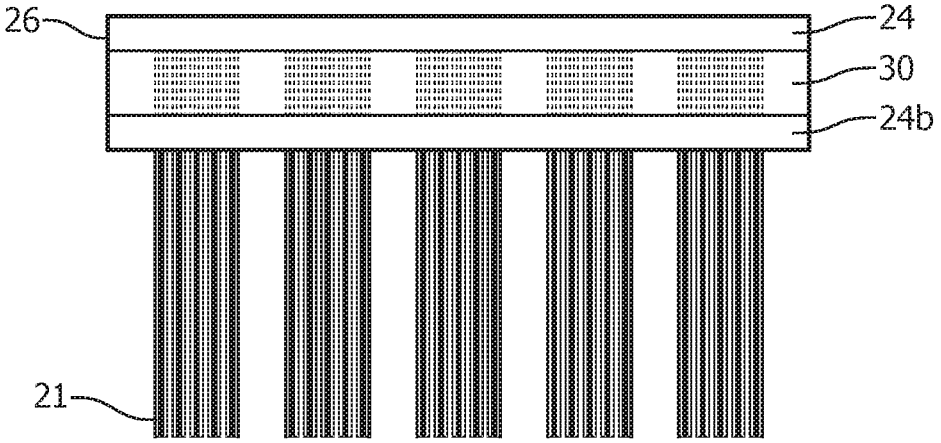
FIG. 7 is a schematic representation of a portion of a brush head assembly in accordance with an embodiment.

According to another embodiment, shown in FIG. 6, the hard platen 24 and/or elastomeric matrix 30 can be connected to or embedded around the neck 40. According to yet another embodiment, shown in FIG. 7, the elastomeric matrix is embedded between two portions of the hard platen, a top portion 24 and a bottom portion 24*b*. The bristle tufts may be retained within either or both of top portion 24 and the bottom portion 24*b* of the hard platen, as well as the elastomeric matrix 30. According to other embodiments, the elastomeric matrix can instead be an overmolded plastic or elastomer-coated metallic or other stiff or springlike component.

Figure 8:
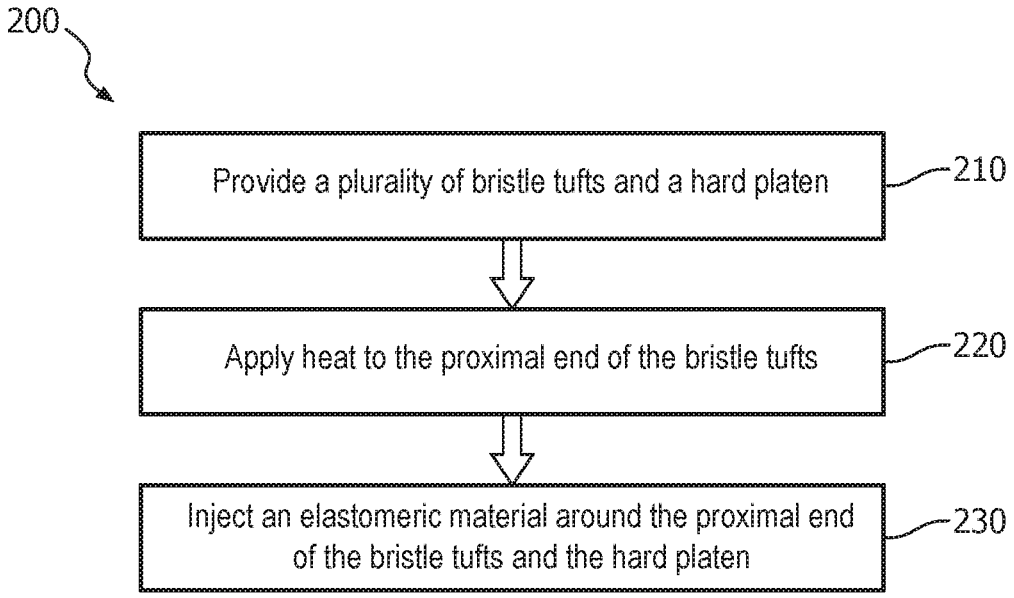
FIG. 8 is a flowchart of a method for manufacturing a brush head assembly with bristle tufts retained within an elastomeric matrix in accordance with an embodiment.
Figure 10A:
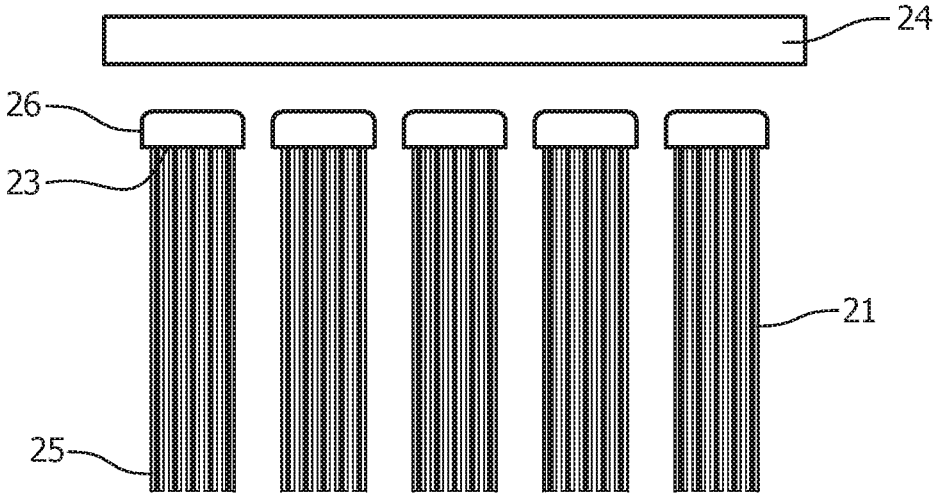
FIG. 10A is a schematic representation of a portion of a brush head assembly in accordance with an embodiment.

Referring to FIG. 8, in one embodiment, is a flowchart of a method 200 for manufacturing a brush head assembly. In step 210 of the method, a hard platen 24 and a plurality of bristle tufts 21 are provided, each of which comprises a plurality of bristle strands. The plurality of bristle tufts 21 are positioned in place in proximity to the hard platen 24, which may be a portion of the neck 40 or another support structure. As shown in FIG. 10A, for example, each of the bristle tufts 21 includes a proximal end 23 and a free end 25. In step 220 of the method, heat is applied to the proximal end 23 of the plurality of bristle tufts 21 to create a proximal end head portion 26. Proximal end head portion 26 is the melted ends of the bristle tuft 21. Heat can be supplied by a heat source that comes into direct physical contact with the proximal end 23 of the bristle tufts. In addition to the direct heat source, the heat can be supplied by heated air or any of a variety of other heat sources.

Figure 10B:
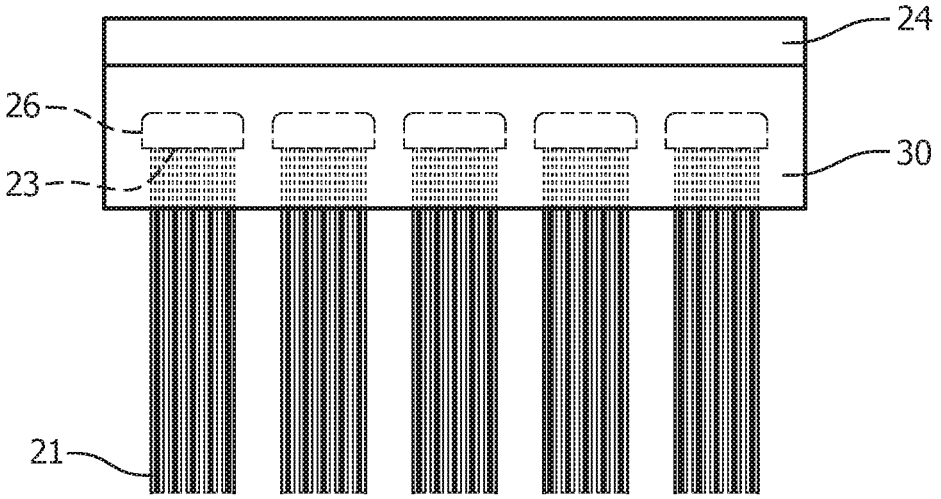
FIG. 10B is a schematic representation of a portion of a brush head assembly in accordance with an embodiment.

In step 230 of method, an elastomeric material is molded over the proximal end head portion 26 of the bristle tufts 21, and is bound to the hard platen 24. The molded elastomeric material forms an elastomeric matrix 30, as shown in FIG. 10B. According to an embodiment, elastomeric matrix 30 is preferably made from a flexible thermoplastic elastomer, and the hard platen 24 is made from a material with a higher elastic modulus than the elastomeric matrix 30.

Figure 9:
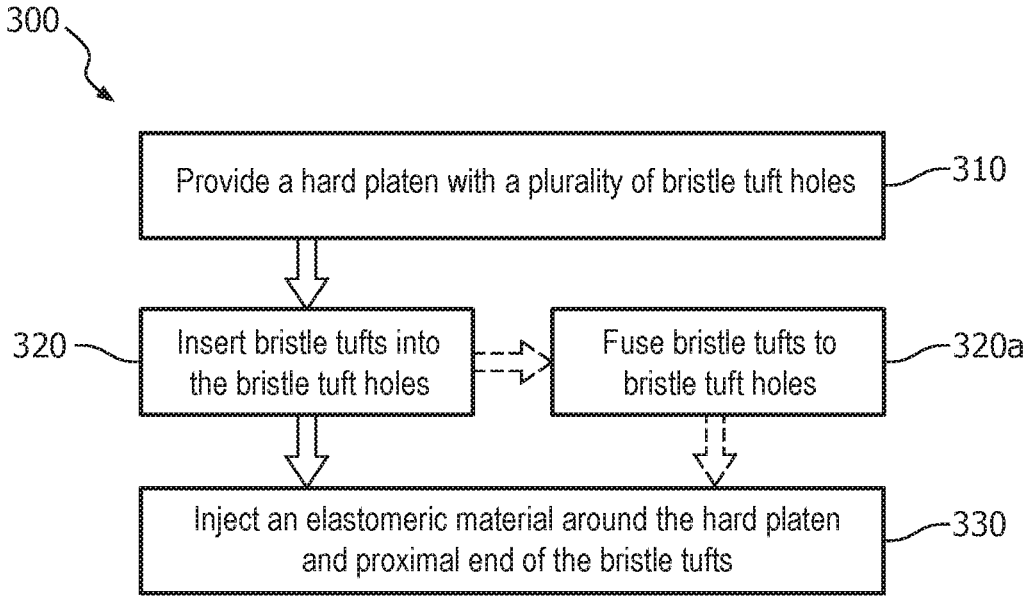
FIG. 9 is a flowchart of a method for manufacturing a brush head assembly with bristle tufts retained within an elastomeric matrix in accordance with an embodiment.

Referring to FIG. 9, in one embodiment, is a flowchart of a method 300 for manufacturing a brush head assembly. In step 310, a hard platen 24 is provided, which may be a portion of the neck 40 or another support structure. The hard platen 24 comprises a plurality of bristle tuft holes 28, as shown in FIG. 5A. In step 320 of the method, bristle tufts 21 are inserted into the bristle tuft holes 28 in the hard platen 24. The bristles can be free within the bristle tuft holes, or can be melted or fused into the bristle tuft holes, or can be molded in place. Accordingly, in optional step 320*a*, heat is applied to each bristle tuft proximal end at a temperature sufficient to at least partially fuse the bristle tuft proximal end to the bristle tuft hole.

In step 330 of the method, the thermoplastic elastomer is then molded over or around the hard platen 24 containing the bristle tufts to form the elastomeric matrix 30 within which the bristle tufts are retained, as shown in FIG. 5B. According to another embodiment, shown in FIG. 6, the hard platen 24 and/or elastomeric matrix 30 can be connected to or embedded around the neck 40. According to yet another embodiment, shown in FIG. 7, the elastomeric matrix is embedded between two portions of the hard platen, a top portion 24 and a bottom portion 24*b*. The bristle tufts may be retained within either or both of top portion 24 and a bottom portion 24*b* of the hard platen, as well as the elastomeric matrix 30.

Figure 11:
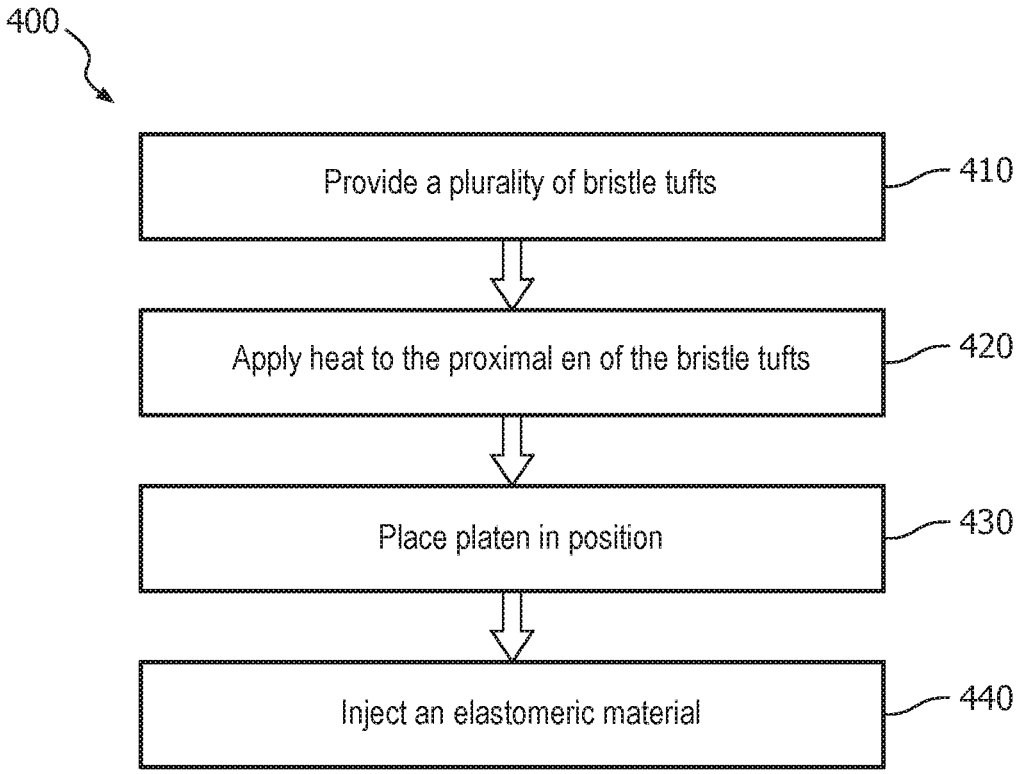
FIG. 11 is a flowchart of a method for manufacturing a brush head assembly with bristle tufts retained within an elastomeric matrix in accordance with an embodiment.

Referring to FIG. 11, in one embodiment, is a method 400 for manufacturing one or more of the various brush head embodiments and implementations described or otherwise envisioned herein. In step 410 of the method, a plurality of bristle tufts 21 (each of which comprises a plurality of bristle strands) are properly positioned. To properly position the bristle tufts, they could be inserted into a tuft ring, a mold, or other positioning mechanism. At step 420 of the method, heat is applied to the proximal end 23 of the bristle tufts 21 to create a proximal end head portion 26. Proximal end head portion 26 is the melted ends of the bristle tuft 21. In contrast with previous embodiments, the head portion 26 of the bristle tufts are large enough to avoid the requirement of a retention ring, and will be suitably held in place solely or largely by the hardening of the elastomeric material around the proximal end head portion 26. Using a polymer with higher adhesion properties would also improve retention.

In step 430 of the method, the platen 24 is positioned in the proper location in relation to the head portion 26 of the bristle tufts. Platen 24 can be properly positioned using a mold, for example, or other positioning mechanism. And in step 440, an elastomeric material is molded over the platen 24 and the head portion 26 of the bristle tufts, to form an elastomeric matrix.

Figure 12A:
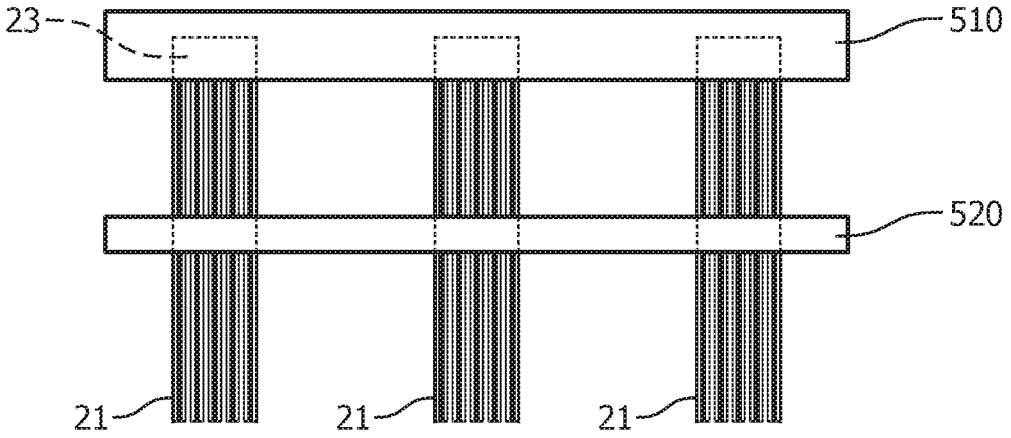
FIGS. 12A-C are schematic representations of a brush head assembly method in accordance with an embodiment.
Figure 12B:
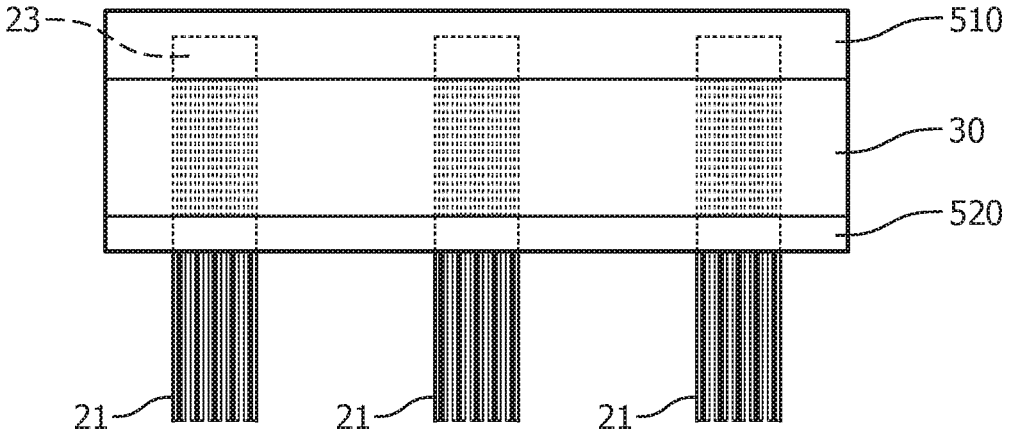
Figure 12C:
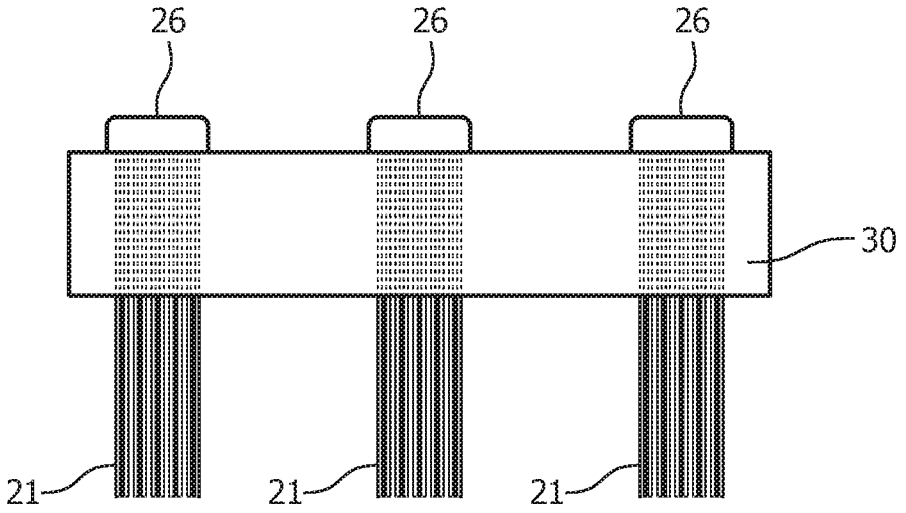
Figure 13:
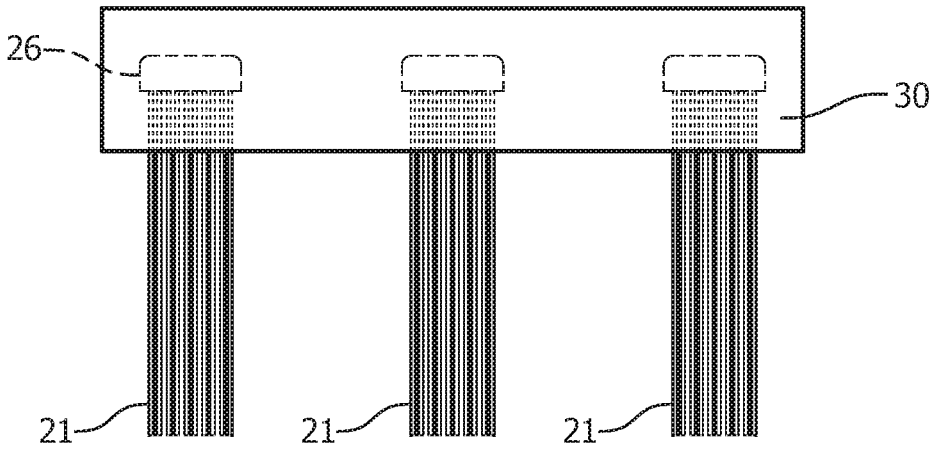
FIG. 13 is a schematic representation of a brush head assembly with bristle tufts retained within an elastomeric matrix in accordance with an embodiment.
Figure 14:
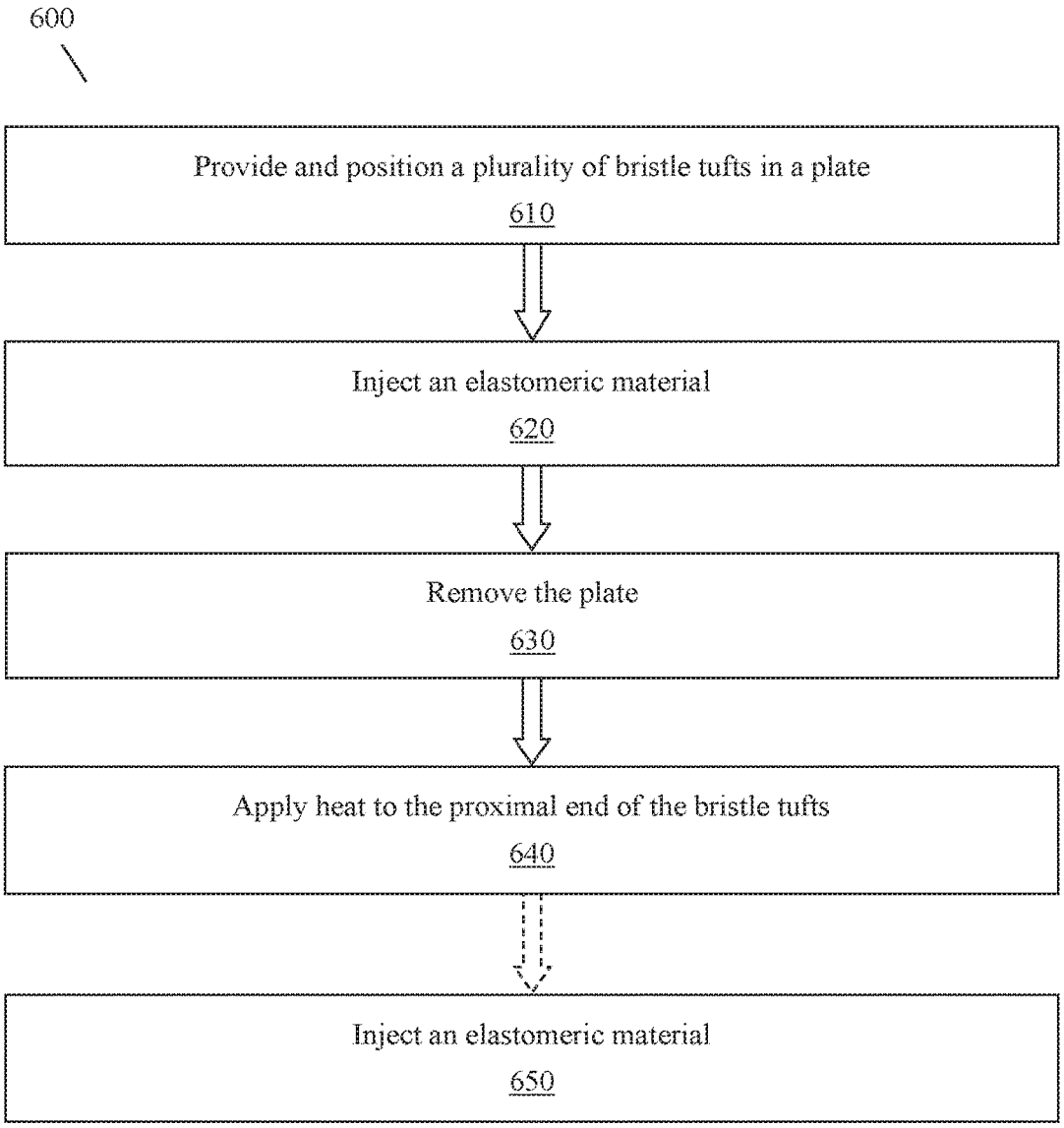
FIG. 14 is a flowchart of a method for manufacturing a brush head assembly with bristle tufts retained within an elastomeric matrix in accordance with an embodiment.

Referring to FIG. 14, in one embodiment, is a method 600 for manufacturing one or more of the various brush head embodiments and implementations described or otherwise envisioned herein. According to this embodiment of the method of manufacture, the bristle tufts protrude through the entire brush head, and a head portion 26 is created on the back of the brush head, as shown in FIG. 12A. Accordingly, the retention force will be sufficient to prevent the bristle tufts from being removed from the brush head. According to this embodiment, in the first step 610 of the method, a plurality of bristle tufts 21 is properly positioned. To properly position the bristle tufts, they are inserted into a top plate 510, and optionally inserted into a bottom plate 520, which are part of the thermoplastic elastomer mold. In the next step 620, an elastomeric material is molded into the space between the top plate 510 and the bottom plate 520 to create an elastomeric matrix 30, as shown in FIG. 12B. In the next step 630 of the method, the top plate 510 is removed. Finally, in step 640, heat is applied as described above to create head portion 26 of each of the bristle tufts, as shown in FIG. 12C. Bottom plate 520 can also be removed if utilized in the method. Optionally, in step 650 of the method, a second molding of elastomeric material can encompass the exposed proximal end head portions 26, thereby resulting in the brush head assembly similar to that depicted in FIG. 13.

In accordance with another embodiment, as shown in FIG. 13, the head portion 26 of each bristle tuft is created prior to injection of the elastomeric material and the creation of the elastomeric matrix 30, and the bristle tufts 21 and head portion 26 is positioned to be embedded within the elastomeric matrix, thereby creating a retaining force to hold the bristle tufts in place. The brush head shown in FIG. 13 could also be manufactured using the steps shown in FIG. 9, followed by a second molding of elastomeric material around the exposed head portions 26.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A brush head assembly comprising:

a first hard platen;

a second hard platen having a plurality of bristle tuft holes therethrough;

a plurality of bristle tufts, each of which comprises a plurality of bristle strands having a proximal end and a free end, wherein each of the plurality of bristle tufts are inserted into a respective one of the bristle tuft holes in the second hard platen; and an elastomeric matrix that is between the second hard platen and the first hard platen and at least partially encompasses the first hard platen and the proximal end of the bristle tufts.

2. The brush head assembly of claim 1, wherein the bristle tufts are fused to the first hard platen.

3. The brush head assembly of claim 1, wherein the elastomeric matrix completely encompasses the first hard platen and the proximal end of the bristle tufts.

4. A method for manufacturing a brush head, the method comprising the steps of:

providing a first hard platen;

providing a second hard platen comprising a plurality of bristle tuft holes inserting a respective proximal end of one of a plurality of bristle tufts into a respective one of the bristle tuft holes; and injecting a thermoplastic elastomer around the first hard platen and between the first hard platen and the second hard platen to create an elastomeric matrix that at least partially encompasses the first hard platen and the proximal end of the bristle tufts.

5. The method of claim 4, further comprising the step of applying heat to each bristle tuft proximal end at a temperature sufficient to at least partially fuse the bristle tuft proximal end to the bristle tuft hole.

6. The method of claim 4, wherein the elastomeric matrix completely encompasses the first hard platen and the proximal end of the bristle tufts and at least partially encompasses the second hard platen.

7. A brush head assembly comprising:

a first hard platen;

a second hard platen having a plurality of bristle tuft holes therethrough;

a plurality of bristle tufts, each of which comprises a plurality of bristle strands having a proximal end and a free end, wherein each of the plurality of bristle tufts are inserted into a respective one of the bristle tuft holes in the second hard platen fused to the first hard platen; and an elastomeric matrix that is between the second hard platen and the first hard platen and at least partially encompasses the first hard platen and the proximal end of the bristle tufts.

* * * * *